US008627875B1

(12) United States Patent
Pinkstock et al.

(10) Patent No.: US 8,627,875 B1
(45) Date of Patent: Jan. 14, 2014

(54) FREIGHT CAR YOKE MOLDING APPARATUS AND METHOD

(75) Inventors: Steven R. Pinkstock, Amanda, OH (US); Craig A. Holman, Newark, OH (US); Ronald A. Poe, Columbus, OH (US)

(73) Assignee: Columbus Steel Castings Company, Columbus, OH (US)

( * ) Notice: Subject to any disclaimer, the term of this patent is extended or adjusted under 35 U.S.C. 154(b) by 353 days.

(21) Appl. No.: 12/504,631

(22) Filed: Jul. 16, 2009

Related U.S. Application Data

(60) Provisional application No. 61/081,378, filed on Jul. 16, 2008.

(51) Int. Cl.
*B22C 9/02* (2006.01)

(52) U.S. Cl.
USPC ..... 164/138; 164/137; 164/340; 164/369

(58) Field of Classification Search
USPC ..... 164/113, 137, 138, 340, 369
See application file for complete search history.

(56) References Cited

U.S. PATENT DOCUMENTS

| | | | | |
|---|---|---|---|---|
| 4,502,525 | A * | 3/1985 | Oshinsky | 164/241 |
| 4,609,030 | A * | 9/1986 | Heater et al. | 164/137 |
| 5,263,533 | A * | 11/1993 | Druschitz et al. | 164/363 |
| 5,769,554 | A * | 6/1998 | Slocum | 403/13 |
| 6,622,776 | B2 * | 9/2003 | Bauer et al. | 164/137 |
| 2004/0055728 | A1 * | 3/2004 | Lewis et al. | 164/131 |

* cited by examiner

*Primary Examiner* — Nicholas P D'Aniello
(74) *Attorney, Agent, or Firm* — Standley Law Group LLP

(57) ABSTRACT

This invention teaches an improved apparatus and method to make metal alloy castings, such as freight car yokes. One embodiment of the invention comprises a core mold assembly unit, wherein the mold unit is filled with molten metal. The core mold assembly units may be further formed of the same material, such as phenolic urethane impregnated sand, which is used to accurately replicate the desired shape of a final desired product.

13 Claims, 3 Drawing Sheets

FREIGHT CAR YOKE MOLDING APPARATUS AND METHOD

CROSS REFERENCE TO RELATED APPLICATIONS

This application is a non-provisional of, and makes claim of the benefit of priority to, U.S. provisional patent application Ser. No. 61/081,378, filed 16 Jul. 2008, which is incorporated by reference as if fully recited herein.

INVENTIVE FIELD

The present invention is directed to a method and apparatus for use in casting, particularly a method and apparatus for more efficiently producing castings of items such as freight car yokes.

BACKGROUND OF THE INVENTIVE FIELD

Casting methods currently used to produce items of metal alloys employ molding techniques that replicate the interior and exterior features of a desired part. Such methods comprise an exterior mold that replicates the external surface features of the desired part, while a core or cores are used to replicate interior cavities and surfaces if such parts embody hollow or reentrant features. The mold and cores are produced from a pattern of the part and are assembled together to produce a cavity that replicates the volume and surface features of the desired part. Cores are subsequently placed within the mold and the mold halves fitted together to form a core mold assembly. A system of sprues, runners, gates and risers embodied within the core mold assembly provide the requisite channels to direct molten metal poured into the formed part cavity to reproduce the part. Molten metal is poured into the mold assembly and is allowed to cool and solidify. Once the casting has cooled sufficiently, the cast part is shaken from the sand mold and the cores removed leaving the desired replicated part. The mold and core sand are usually reclaimed and reused.

Of the various types of molding methods used, molds made from "green sand" are the most widely used. Green sand is made from a pliable mixture of sand, clay, and water that coheres and can be molded in such a fashion as to faithfully replicate surface features of the part pattern shape. However, significant disadvantages are associated with the green sand method, some of which are the need for careful handling of the mold assembly due to the relative fragility of the green sand, as well as undesirable dimensional variations between castings associated with mold cavity, core misalignment and pattern wear. Additionally, green sand molding techniques typically employ core sand compositions that differ from molding sand making reclamation of these components difficult in that they are mixed during the part removal process and thus can cross-contaminate each other. Furthermore, multiple parts are typically cast at one time by using a plurality of part patterns to form several mold cavities within a single flask (i.e., frame) using a system of common runners. Such an arrangement increases the number of parts that may need to be scrapped due to core mold assembly misalignments and cold-shunting. What is needed is an improved casting apparatus and method to overcome these and other drawbacks.

SUMMARY OF THE GENERAL INVENTIVE CONCEPT

Exemplary embodiments of the casting apparatus and method disclosed herein address traditional shortcomings of green sand molding by employing a variation on the phenolic urethane cold-box system to produce stronger molds and cores of higher dimensional accuracy. Although other core and mold making methods may be embodied within this invention, the cold-box method employs molding sand impregnated with phenolic urethane "no-bake" (hence "cold-box") binders typically used to form molding cores. One principal advantage of using a phenolic urethane binder is that it can be rapidly catalyzed at room temperature by means of an amine vapor that is blown through the core sand to produce durable cores. Removal of the core from the cast part is facilitated by carefully controlling the composition of the phenolic urethane impregnated sand and the curing conditions. An embodiment extends the use of the cold-box method to include forming the mold as well as the core resulting in a sturdy core mold assembly that has superior dimensional stability as well as improved structural integrity that permits more aggressive handling of mold components than is possible when using a relatively fragile green sand. Furthermore, this approach reduces the likelihood of misalignments in a core mold assembly and improves the finish of the cast part, consequently reducing finishing costs and part scrap rate. Moreover, with the tolerances desired during fabrication of freight car yokes, there may be no additional finishing required after casting. Additionally, depending on the part geometry, exemplary embodiments also may reduce the number of needed cores used to produce a cast part. In contrast to multiple-part green sand molding methods, exemplary embodiments also may be employed to form individual or modular core mold assembly units used to form individual parts.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
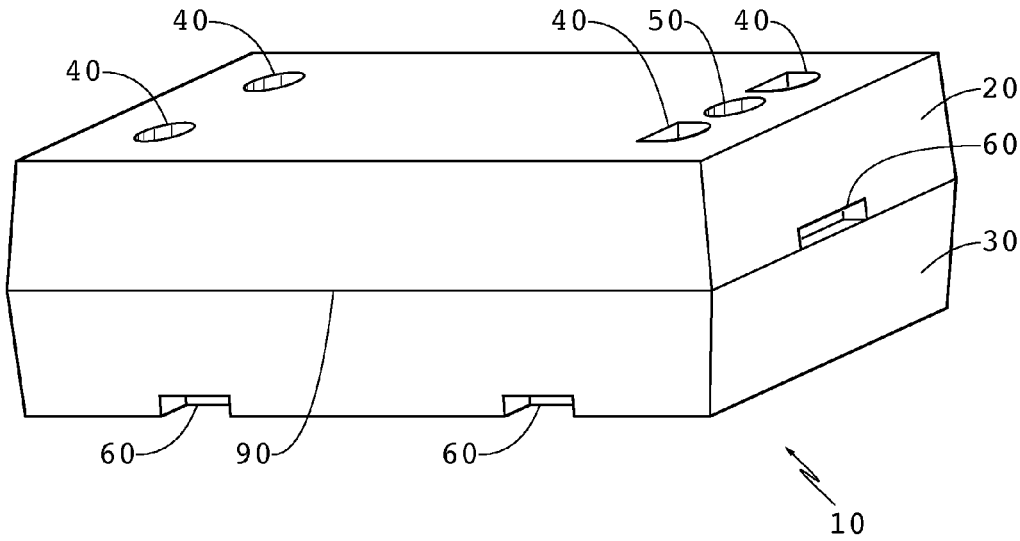
FIG. 1 is a perspective view of one exemplary embodiment of the present invention illustrating a core mold assembly unit.

Exemplary embodiments of the apparatus and molding method are directed to casting technology. In addition, the apparatus and method involves the use of a core mold assembly unit to produce independently formed parts. FIG. 1 shows an example of a core mold assembly unit 10, which comprises a core mold upper half 20, a core mold lower half 30, riser vents 40, a filling gate 50, a handling groove or grooves 60, and split line 90.

Figure 2:
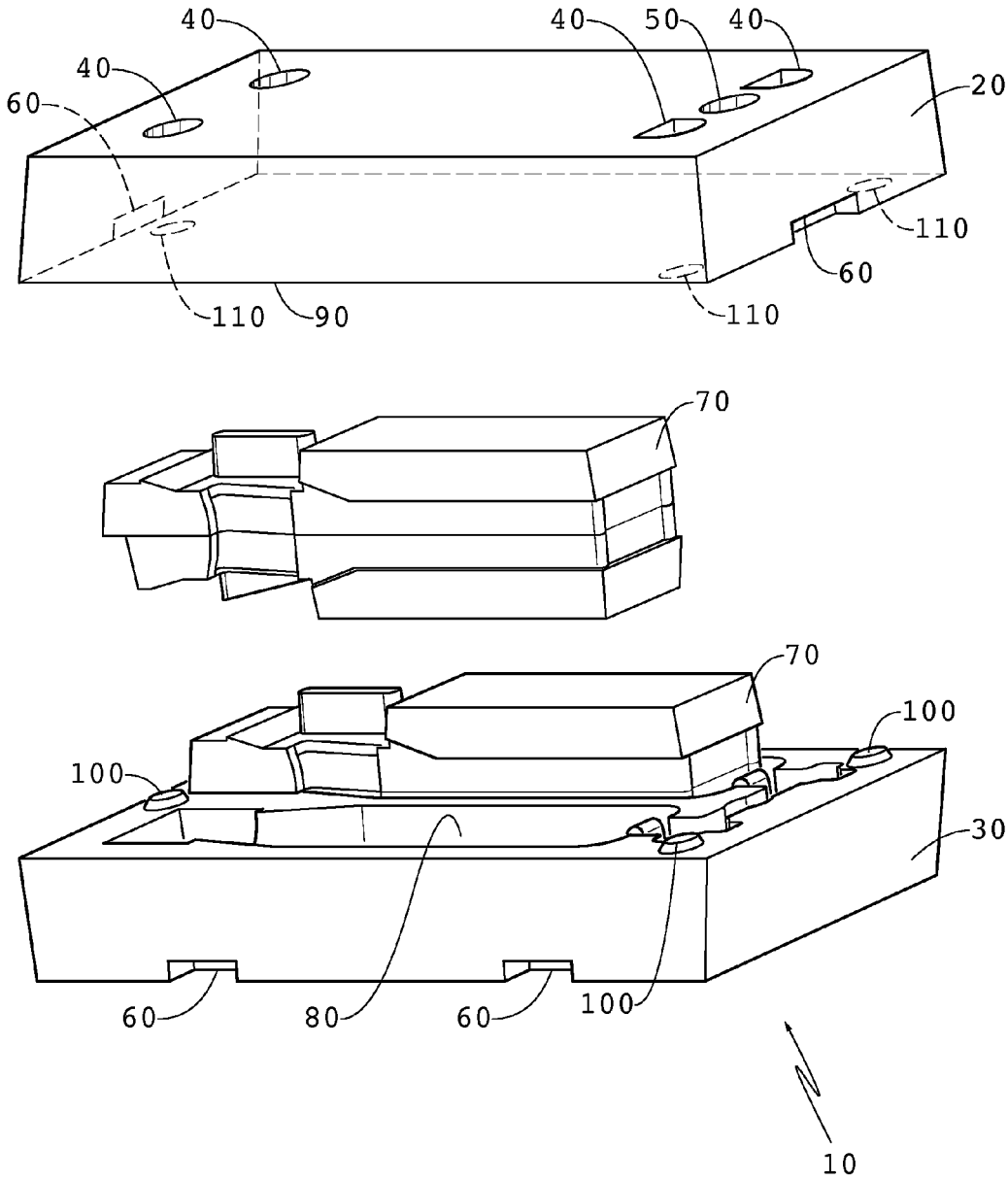
FIG. 2 shows the exemplary embodiment of FIG. 1, illustrating core mold assembly unit elements separated across the core mold assembly split line, thereby exposing details of the internal components and features of the assembly.
Figure 3:
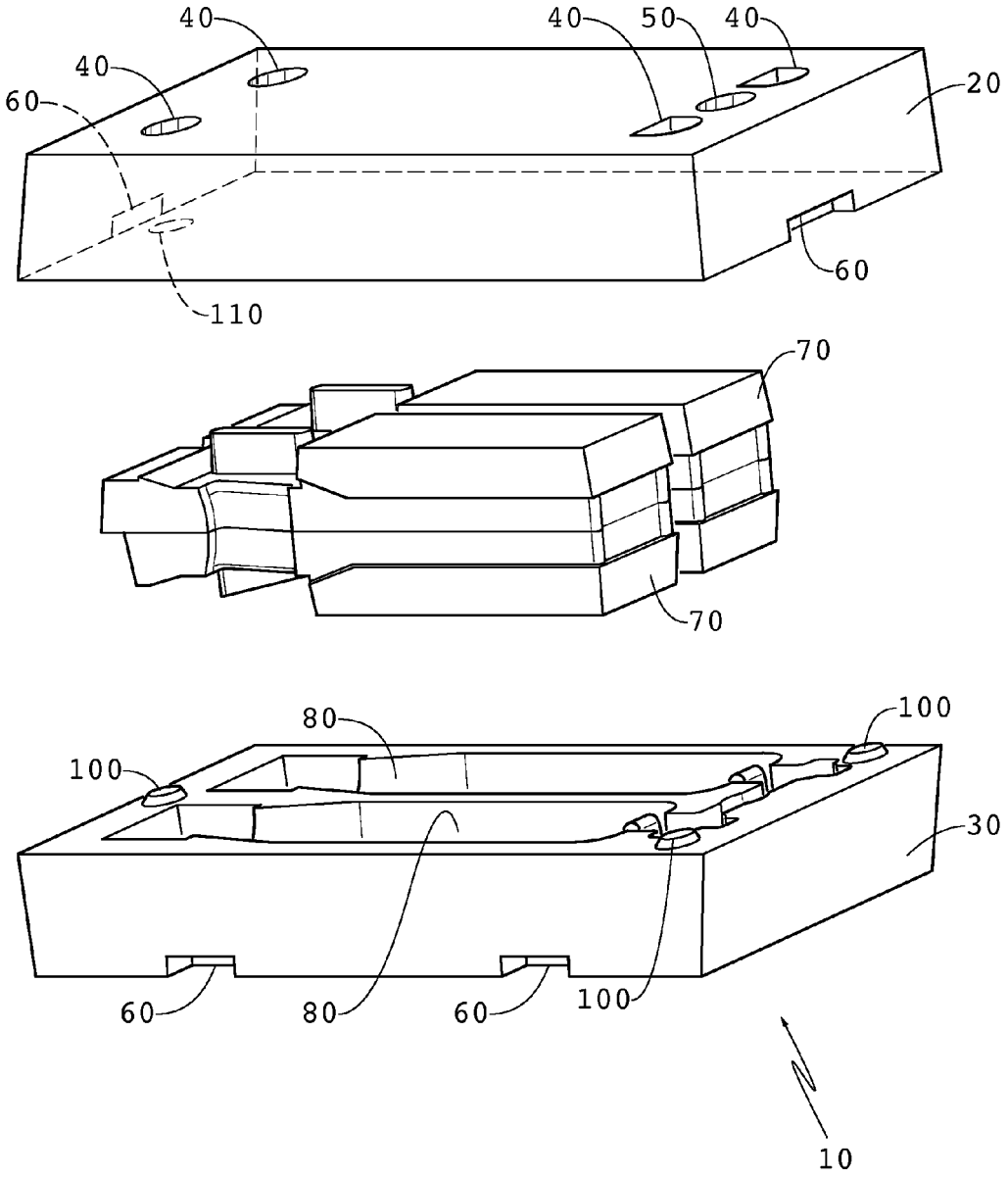
FIG. 3 is a partially exploded view of the exemplary embodiment of FIG. 1, further illustrating the core mold assembly unit elements and details of the internal components and features of the assembly.

FIGS. 2 and 3 further illustrate the core mold assembly unit 10 separated into a core mold assembly unit upper half 20 and core mold assembly unit lower half 30 along the split line 60. FIGS. 2 and 3 reveal the internal details of a core assembly 70 and mold cavity 80, which in this example, represents the molding features of freight car yokes. In one preferred embodiment, the core mold assembly unit 10 is comprised of phenolic urethane treated molding sand, which lends itself to fabrication using the cold-box system. Using this technique, sand may be blown onto replicate patterns of the desired part within individual cope and drag flasks and catalyzed with an amine vapor to enhance its mechanical properties, thereby forming relatively durable core mold components 20, 30 and a mold cavity 80 that accurately replicates the external features of the part. The core or cores 70, used to replicate the internal features of a part, may be produced using the same method (i.e., cores are made in a cold box from phenolic urethane treated molding sand) depending on the need for such as dictated by the part geometry. To reduce the effects of pattern wear and consequent irregularity between castings, one exemplary embodiment of the invention employs durable cast-iron or steel patterns to replicate the desired geometry and features of part cavity 80 and core or cores 70 within the phenolic urethane treated molding sand during the core mold assembly unit 10 fabrication process.

Exemplary embodiments of a core mold assembly unit 10 may include handling grooves (e.g. grooves 60) to provide a means to easily lift and transport the core mold assembly unit 10. In this particular embodiment, four handling grooves 60, two on each side of the length, are located on the bottom face of the core mold lower half 30. Further, two additional handling grooves 60, one on each side of the width, are located on the bottom face of the core mold upper half 20. While not shown herein, it can be understood that such grooves 60 may pass fully through the core mold assembly lower half. In other exemplary embodiments, the handling grooves 60 may be located on other surfaces of the core mold assembly unit 10. The filling gate 50 provides an entryway for the introduction of molten metal into the core mold assembly unit 10. In this particular embodiment, the filling gate 50 is located substantially along the midline of the right side width of the core mold upper half 20. The riser vent(s) 40 provide venting of the core mold assembly unit 10 during molten metal insertion. In this particular embodiment, the core mold assembly unit 10 has four riser vents 40 that are situated towards the four corners of the core mold upper half 20.

Exemplary embodiments of the core molding assembly unit may include a protrusion 100 on the upper face of the core mold lower half 30 that has a complementary receiving cavity 110 on the lower face of the core mold upper half 20. In this particular embodiment, the core mold lower half 30 has three protrusions 100. Two of the protrusions 100 are positioned towards the corners of the right side of he core mold lower half 30, and the third protrusion 100 is located at substantially the midpoint of the width of the left side of the core mold lower half 30. The core mold upper half 20 has three complementary receiving cavities 110 that are located in complementary positions to the protrusions 110; two of the receiving cavities 110 are positioned towards the corners of the right side of he core mold upper half 20, and the third receiving cavity 110 is located at substantially the midpoint of the width of the left side of the core mold upper half 20. The use of such protrusions 100 and complementary receiving cavities 110 facilitates proper alignment of the core mold upper half 20 to the core more lower half 30 during the production of the freight car yokes.

During a casting operation, molten metal is poured into a filling gate 50, as shown in FIG. 1, which subsequently flows into the core mold assembly unit cavity 80. The pouring of molten metal is typically continued until molten metal is observed to approach or exit the riser vents 40 thus ensuring that core mold assembly unit cavities 80 are completely filled to form the desired part. In this particular embodiment, the core mold assembly unit 10 produces two substantially identical freight car yokes. Each core mold assembly unit cavity 80 is located substantially equidistant from the midline of the length of the core mold assembly unit 10, wherein the left and right side of the length of the core mold upper and lower halves 20 and 30 are substantially symmetrical.

A molding method and apparatus of the present invention may eliminate the need for pattern gauging. Also, such a molding method and apparatus may improve component alignment, reduce the amount of casting defects, and lower the scrap rate caused by misaligned core mold halves. Furthermore, such a method and apparatus may permit more aggressive handling of molding components, thereby improving part production rate. As a result of practicing the present invention, the dimensional stability of parts from casting to casting may be improved, thereby reducing the finishing cost for parts produced (sometimes eliminating the need for an additional finishing step(s)). The reclamation of molding and core sand is also facilitated by practicing the present invention. Also, the number of cores needed may in some cases be reduced and the core or core assemblies within the mold cavity may be simplified.

It should be noted that the exemplary embodiments shown and described herein are not to be considered limiting or restrictive in any fashion. Rather, a number of core mold assembly units and possible casting configurations may be practiced, as would be understood by those skilled in the art.

While certain embodiments of the present invention are described in detail above, the scope of the invention is not to be considered limited by such disclosure, and modifications are possible without departing from the spirit of the invention as evidenced by the following claims:

What is claimed is:

1. A method for casting a freight car yoke using a core mold assembly unit, the method comprising:

providing a core mold assembly unit formed from phenolic urethane treated molding sand, the core mold assembly unit including a core mold upper half and a core mold lower half mated at a common split line defining a mold, at least one riser vent in the core mold upper half, at least one filling gate in the core mold upper half, at least one mold cavity which replicates the exterior features of a cast freight car yoke, and at least one core located inside the mold cavity that replicates the interior features of a cast freight car yoke, and first and second lifting grooves positioned on opposing bottom edges of the core mold lower half; and pouring molten metal through the filling gate and into the core mold assembly unit through the core mold assembly unit filling gate, thereby filling the core mold assembly unit cavity to cast at least one freight car yoke.

2. The casting method of claim 1, wherein the core mold lower half includes a protrusion and the core mold upper half includes a complementary receiving cavity.

3. The casting method of claim 1, wherein the pouring of the molten metal continues until molten metal is observed to approach or exit at least one riser vent.

4. The casting method of claim 1, wherein four lifting grooves, two on each side of the length, are located on the bottom face of the core mold lower half.

5. The casting method of claim 1, wherein two lifting grooves, one on each side of the width, are located on the bottom face of the core mold upper half.

6. The casting method of claim 2, wherein the core mold lower half has three protrusions with two of the protrusions positioned towards the corners of the right side of the core mold lower half, and the third protrusion located at substantially the midpoint of the width of the left side of the core mold lower half, the core mold upper half has three complementary receiving cavities that are located in complementary positions to the protrusions, two of the receiving cavities positioned towards the corners of the right side of the core mold upper half, and the third receiving cavity is located at substantially the midpoint of the width of the left side of the core mold upper half.

7. A method for casting a freight car yoke using a core mold assembly unit, the method comprising:

providing a core mold assembly unit formed from phenolic urethane treated molding sand, the core mold assembly unit including a core mold upper half and a core mold lower half mated at a common split line defining a mold, at least one riser vent in the core mold upper half, at least one filling gate in the core mold upper half, at least one mold cavity which replicates the exterior features of a cast freight car yoke, a groove feature to facilitate ease of handling the core mold assembly unit to lift and transport the core mold assembly unit, the core mold lower half includes a protrusion and the core mold upper half includes a complementary receiving cavity; and at least one core located inside the mold cavity that replicates the interior features of a cast freight car yoke; and pouring molten metal through the filling gate and into the core mold assembly unit through the core mold assembly unit filling gate, thereby filling the core mold assembly unit cavity to cast at least two freight car yokes at substantially the same time.

8. The casting method of claim 7, wherein the pouring of the molten metal continues until molten metal is observed to approach or exit at least one riser vent.

9. The casting method of claim 7, wherein four handling grooves, two on each side of the length, are located on the bottom face of the core mold lower half.

10. The casting method of claim 7, wherein two handling grooves, one on each side of the width, are located on the bottom face of the core mold upper half.

11. The casting method of claim 7, wherein the core mold lower half has three protrusions with two of the protrusions positioned towards the corners of the right side of the core mold lower half, and the third protrusion located at substantially the midpoint of the width of the left side of the core mold lower half, the core mold upper half has three complementary receiving cavities that are located in complementary positions to the protrusions, two of the receiving cavities positioned towards the corners of the right side of the core mold upper half, and the third receiving cavity is located at substantially the midpoint of the width of the left side of the core mold upper half.

12. A method for casting a freight car coupler connection member using a core mold assembly unit, comprising:

providing a core mold assembly unit formed from phenolic urethane treated molding sand, the core mold assembly unit including a core mold upper half and a core mold lower half mated at a common split line defining a mold, at least one riser vent in the core mold upper half, at least one filling gate in the core mold upper half, at least one mold cavity which replicates the exterior features of a cast freight car yoke, a first pair of lifting grooves located on a bottom edge of the core mold lower half and a second pair of lifting grooves located on an opposing bottom edge of the core mold lower half, and at least one core located inside the mold cavity that replicates the interior features of a cast freight car coupler connection member, the member comprising a housing framework with a main aperture formed therethrough which is sized and shaped to accommodate a freight car draft gear and a second aperture adapted to accept a tie member for connecting the member to a freight car coupler; and pouring molten metal through the filling gate and into the core mold assembly unit through the core mold assembly unit filling gate, thereby filling the core mold assembly unit cavity to cast at least one freight car coupler connection member.

13. The casting method of claim 12 further comprising the step of:

lifting the core mold assembly unit by applying an upward force to the first and second pairs of lifting grooves.

* * * * *

UNITED STATES PATENT AND TRADEMARK OFFICE

CERTIFICATE OF CORRECTION

PATENT NO. : 8,627,875 B1
APPLICATION NO. : 12/504631
DATED : January 14, 2014
INVENTOR(S) : Pinkstock et al.

It is certified that error appears in the above-identified patent and that said Letters Patent is hereby corrected as shown below:

In the Specification:
Column (3) Line (56), please delete “he” and insert --the--.

In the Claims:
Column (4) Line (45), please delete “and”.

Signed and Sealed this
Sixth Day of May, 2014

Michelle K. Lee

Michelle K. Lee
*Deputy Director of the United States Patent and Trademark Office*